US008761405B2

(12) United States Patent
Ikeda et al.

(10) Patent No.: US 8,761,405 B2
(45) Date of Patent: Jun. 24, 2014

(54) NARROW DIRECTIONAL STEREO MICROPHONE

(75) Inventors: Tatsuya Ikeda, Tokyo (JP); Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 330 days.

(21) Appl. No.: 13/399,366

(22) Filed: Feb. 17, 2012

(65) Prior Publication Data

US 2013/0216046 A1 Aug. 22, 2013

(30) Foreign Application Priority Data

Feb. 25, 2011 (JP) ..... 2011-039313

(51) Int. Cl.
*H04R 5/00* (2006.01)

(52) U.S. Cl.
USPC ..... 381/26

(58) Field of Classification Search
USPC ..... 381/26
See application file for complete search history.

(56) References Cited

U.S. PATENT DOCUMENTS

| | | | | |
|---|---|---|---|---|
| 4,206,324 | A * | 6/1980 | Horikawa et al. | 381/27 |
| 4,466,117 | A | 8/1984 | Gorike | |
| 5,675,655 | A * | 10/1997 | Hatae | 381/26 |
| 2008/0152154 | A1 * | 6/2008 | Daishin et al. | 381/26 |

FOREIGN PATENT DOCUMENTS

| | | |
|---|---|---|
| JP | S5892193 A | 6/1983 |
| JP | 05-219590 | 8/1993 |
| JP | 2006-174136 | 6/2006 |
| JP | 2010-183249 | 8/2010 |

* cited by examiner

*Primary Examiner* — Simon Sing
(74) *Attorney, Agent, or Firm* — Whitham Curtis Christofferson & Cook, PC

(57) ABSTRACT

A narrow directional stereo microphone includes a narrow directional mid unit disposed such that the directional axis thereof aligns to the major axis of a microphone body, and a unidirectional right unit and a unidirectional left unit disposed symmetrically with respect to the major axis such that directional axes of the right and left units are perpendicular to the major axis, wherein signals output from the mid unit are sent to one of a diaphragm and a fixed electrode of the right unit and to one of a diaphragm and a fixed electrode of the left unit, and right channel signals are output from the other of the diaphragm and the fixed electrode of the right unit, and left channel signals are output from the other of the diaphragm and the fixed electrode of the left unit.

20 Claims, 12 Drawing Sheets

NARROW DIRECTIONAL STEREO MICROPHONE

TECHNICAL FIELD

The present invention relates to a narrow directional stereo microphone including a combination of one narrow directional microphone unit and two unidirectional microphone units.

BACKGROUND ART

One of the stereo recording systems is a mid-side (MS) stereo recording system. The MS stereo recording system includes two microphones, i.e., a mid microphone (hereinafter, its output signal is referred to as "signal M") and a side microphone (hereinafter, its output signal is referred to as "signal S"). The mid microphone has unidirectionality or narrow directionality, and is disposed so as to face the center of a sound source. The side microphone has a bidirectionality, and is disposed perpendicularly to the direction of the sound source. The sum M+S of and the difference M−S between the signals M and S are calculated, and converted to stereo signals for right and left channels, respectively, and the stereo signals are then output. The mid and side microphone units are accommodated in one microphone casing into an MS stereo microphone.

FIG. 12 illustrates a typical conventional MS stereo microphone. In FIG. 12, a mid microphone unit 20 and a side microphone unit 30 are capacitor microphone units. The mid microphone unit 20 includes a diaphragm 201 and a fixed electrode 202 opposed to each other at an appropriate space so as to define a capacitor. The side microphone unit 30 also includes a diaphragm 301 and a fixed electrode 302 defining a capacitor. The mid microphone unit 20 is disposed to face the front in a microphone casing (not shown). The side microphone unit 30 is disposed sideways in the microphone casing, namely, disposed perpendicularly to a sound collection axis of the mid microphone unit 20. The mid microphone unit 20 has unidirectionality or narrow directionality. The side microphone unit 30 has bidirectionality.

The diaphragms 201 and 301 of the mid and side microphone units 20 and 30, respectively, are connected to ground GND. In the mid and side microphone units 20 and 30, the diaphragms 201 and 301 vibrate upon receiving sound waves, and their distances from the fixed electrodes 202 and 302 vary, leading to variations in capacitance. Such variations in capacitance are output from the fixed electrodes 202 and 302 as sound signals. The sound signals output from the fixed electrode 202 of the mid microphone unit 20 are converted to low-impedance signals by an impedance conversion circuit mainly including an FET 40. The impedance conversion circuit further includes a bias circuit 10 and a load resistance 41. A DC supply voltage VDD is applied to the drain of the FET 40.

In this circuit configuration, the sound signals, which are output from the mid microphone unit 20 and subjected to impedance conversion, are sent to a buffer amplifier mainly including a transistor 45 through a coupling capacitor 42. Signals output from the buffer amplifier are sent to a positive terminal of each of primary windings of matrix transformers 70 and 80 through a coupling capacitor 48. The DC supply voltage VDD is divided by resistive dividers 43 and 44, and such a divided voltage is applied to the base of the transistor 45. The DC supply voltage VDD is applied to the collector of the transistor 45 through a resistance 46. The emitter of the transistor 45 is connected to the ground GND through a resistance 47. A positive terminal of a secondary winging of the matrix transformer 70 is connected to an output terminal L of a left channel. A negative terminal of the secondary winging is connected to the ground GND.

A circuit for the side microphone unit 30 also includes an impedance conversion circuit mainly including an FET 60 and a buffer amplifier mainly including a transistor 65, as in the circuit for the mid microphone unit 20. The collector of the transistor 65 defining the buffer amplifier outputs negative-phase signals −S from the side microphone unit 30. The emitter of the transistor 65 outputs positive-phase signals +S from the side microphone unit 30. The circuit further includes a bias circuit 50 of the impedance conversion circuit, a load resistance 61, a coupling capacitor 62 between the impedance conversion circuit and the buffer amplifier, resistive dividers 63 and 64, a resistance 66 connected between a DC power supply and the collector of the transistor 65, and a resistance 67 connected between the emitter of the transistor 65 and the ground GND. The negative-phase signals −S from the microphone unit 30 are output from the collector of the transistor 65, and then sent to a negative terminal of the primary winding of the matrix transformer 70 through a coupling capacitor 68. The positive-phase signals +S from the microphone unit 30 are output from the emitter of the transistor 65, and then sent to a negative terminal of the primary winding of the matrix transformer 80 through a coupling capacitor 69. A positive terminal of a secondary winging of the matrix transformer 80 is connected to an output terminal R of a right channel. A negative terminal of the secondary winging of the matrix transformer 80 is connected to the ground GND.

The sound signals from the mid microphone unit 20 and the side microphone unit 30 are subjected to impedance conversion, and then converted to the signals M+S and the signals M−S through the buffer amplifiers and the matrix transformers 70 and 80, and then output as left channel signals and right channel signals, respectively. This is described in further detail. On the side of the mid microphone unit 20, the signal M is output from the buffer amplifier mainly including the transistor 45. Among the sound signals from the side microphone unit 30, the signal −S is output from the collector of the transistor 65 as a main component of the buffer amplifier, and the signal +S is output from the emitter of the transistor 65. Thus, the positive terminal of the primary winding of the matrix transformer 70 receives the signal M, and the negative terminal thereof receives the signal −S, and thus the positive terminal of the secondary winding of the matrix transformer 70 outputs the signal M+S, as a left channel signal from the output terminal L. In addition, the positive terminal of the primary winding of the matrix transformer 80 receives the signal M, and the negative terminal thereof receives the signal +S, and thus the positive terminal of the secondary winding of the matrix transformer 80 outputs the signal M−S, as a right channel signal from the output terminal R.

In this way, the conventional MS stereo microphone, which includes a unidirectional or narrow directional microphone unit for the mid microphone unit and a bidirectional microphone unit for the side microphone unit, can output stereo sound signals separated for left and right channels through electroacoustic conversion. The disadvantage of the conventional MS stereo microphone, however, is use of the bidirectional microphone unit. To achieve bidirectionality of a capacitor microphone unit, fixed electrodes must be oppositely disposed on two sides of a diaphragm while acoustic resistances must be symmetrically disposed on the two sides, in order to adjust the value of each acoustic resistance. In addition, in the conventional MS stereo microphone, such a symmetric layout of the acoustic resistances sandwiching the diaphragm does not always provide the bidirectionality unless an optimum design is found for the bidirectionality. Furthermore, the bidirectional microphone unit is expensive compared with the unidirectional microphone unit. In addition, the conventional MS stereo microphone must have a matrix circuit for obtaining a sum signal and a difference signal of the signals M and S, so that cost inevitably increases. In the example shown in FIG. 12, the matrix transformers 70 and 80 function as matrix circuits. Instead, each matrix circuit may include an active element such as a transistor. In each case, the matrix circuit causes an increase in cost.

Japanese Unexamined Patent Application Publication No. 2006-174136 (W-A-2006-174136) describes an MS stereo microphone. This stereo microphone includes a unidirectional mid unit and a bidirectional side unit facing perpendicularly to each other. A fixed electrode of the mid unit is electrically connected to a diaphragm of the side unit, and a first fixed-electrode of the side unit is connected to the gate of a first FET, and a second fixed-electrode of the side unit is connected to the gate of a second FET. Furthermore, in the stereo microphone described in JP-A-2006-174136, a diaphragm of the mid unit and sources of the first and second FETs are connected to ground, and drains of the first and second FETs provide stereo output.

The microphone described in JP-A-2006-174136 does not require the above-described matrix circuit, but must include a bidirectional microphone unit as a side unit, causing an increase in cost.

Japanese Unexamined Patent Application Publication No. H05-219590 (JP-A-H05-219590) describes a stereo microphone, similar to a MS stereo microphone, which includes a unidirectional or bidirectional mid unit, a unidirectional left-side-unit, and a unidirectional right-side-unit. The mid unit is disposed such that the directional axis thereof aligns to the major axis of a microphone body. The left and right side units are disposed symmetrically with respect to the major axis such that the directional axes thereof are orthogonal to the major axis. A signal output from the mid unit and a signal output from the left side unit are added by an adder, and the added signal is output as a left side signal. The signal output from the mid unit and a signal output from the right side unit are added by another adder, and the added signal is output as a right side signal.

The stereo microphone described in JP-A-H05-219590 does not require a bidirectional microphone unit, but must include the adders, resulting in an increase in cost.

SUMMARY OF INVENTION

Technical Problem

An object of the invention is to solve the problems in the related art as described above, namely, to provide a narrow directional stereo microphone including a mid microphone unit and a side microphone unit without a bidirectional microphone unit and a matrix circuit.

Solution to Problem

A narrow directional stereo microphone according to the present invention includes a mid capacitor microphone unit having narrow directionality disposed such that the directional axis thereof aligns to the major axis of a microphone body; and a unidirectional right capacitor microphone unit and a unidirectional left capacitor microphone unit disposed symmetrically with respect to the major axis such that directional axes of the right and left capacitor microphone units are perpendicular to the major axis, wherein signals output from the mid capacitor microphone unit are sent to one of a diaphragm and a fixed electrode of the right capacitor microphone unit and to one of a diaphragm and a fixed electrode of the left capacitor microphone unit, and right channel signals are output from the other of the diaphragm and the fixed electrode of the right capacitor microphone unit, and left channel signals are output from the other of the diaphragm and the fixed electrode of the left capacitor microphone unit.

Advantageous Effects of Invention

The narrow directional stereo microphone according to the present invention does not need a bidirectional microphone unit and a matrix circuit, leading to a reduction in cost.

DESCRIPTION OF EMBODIMENT

Hereinafter, a narrow directional stereo microphone according to an embodiment of the present invention is described with reference to the accompanying drawings.

Figure 1:
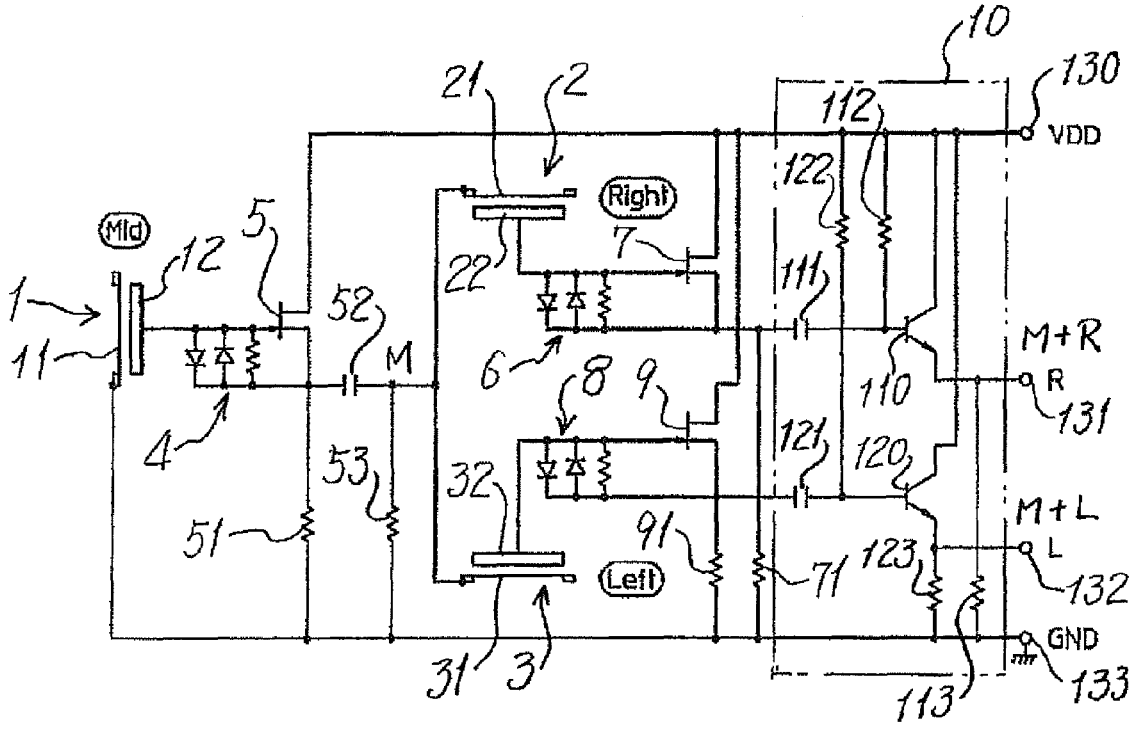
FIG. 1 is a circuit diagram illustrating an exemplary narrow directional stereo microphone according to the present invention.

In FIG. 1, a mid microphone unit 1, a right microphone unit 2, and a left microphone unit 3 are of a capacitor type. The mid unit 1 includes a diaphragm 11 and a fixed electrode 12 opposed to each other at an appropriate space so as to define a capacitor. The right unit 2 also includes a diaphragm 21 and a fixed electrode 22 defining a capacitor. The left unit 3 also includes a diaphragm 31 and a fixed electrode 32 defining a capacitor. The mid unit 1 is disposed to face the front in a microphone casing (not shown). In detail, the mid unit 1 is disposed such that its directional axis aligns to the major axis of a microphone body. The right and left units 2 and 3 are disposed sideways in the microphone casing, namely, disposed outwardly and symmetrically with respect to the major axis such that their directional axes are perpendicular to the major axis. The mid unit 1 has narrow directionality provided by attaching a microphone module to one end of an elongated acoustic tube, for example. Each of the right and left units 2 and 3 has unidirectionality. The microphone casing accommodating the mid unit 1 and the right and left units 2 and 3 may be integrally molded, or may be formed by joining separate casings into one unit.

The diaphragm 11 of the mid unit 1 is connected to ground GND, and sound signals are subjected to electroacoustic conversion in the mid unit 1 and then output from the fixed electrode 12. The sound signals are subjected to impedance conversion by an FET 5 that defines an impedance conversion circuit, and then sent to the diaphragms 21 and 31 of the right and left units 2 and 3 through a coupling capacitor 52. The impedance conversion circuit has a self-bias circuit 4. A load resistance 51 of the impedance conversion circuit is connected between the source of the FET 5 and the ground GND. A resistance 53 is connected between the diaphragm 21 of the right unit 2 and the ground GND and between the diaphragm 31 of the left unit 3 and the ground GND.

Sound signals are subjected to electroacoustic conversion in the right and left units 2 and 3 and then output from the fixed electrodes 22 and 32, respectively. The sound signals are subjected to impedance conversion by FETs 7 and 9, respectively, that define first and second impedance conversion circuits. The FETs 7 and 9 are connected such that the sound signals are sent to a buffer 10 through coupling capacitors 111 and 121, respectively. A DC voltage VDD is applied to the drains of the FET 5 and the FETs 7 and 9 from a power supply terminal 130. The FETs 7 and 9 have self-bias circuits 6 and 8, respectively. A load resistance 71 of the first impedance conversion circuit is connected between the source of the FET 7 and the ground GND. A load resistance 91 of the second impedance conversion circuit is connected between the source of the FET 9 and the ground GND.

The buffer 10 includes a transistor 110 that receives the signals output from the right unit 2 and a transistor 120 that receives the signals output from the left unit 3. The collectors of the transistors 110 and 120 receive the DC voltage VDD. The bases of the transistors 110 and 120, respectively, receive the power supply voltage VDD through resistances 112 and 122. The emitters of the transistors 110 and 120 are, respectively, connected to the ground GND through load resistances 113 and 123. In addition, the respective emitters are connected to output terminals 131 and 132. The output terminal 131 is a terminal for a right channel while the output terminal 132 is a terminal for a left channel. The microphone is connected to an external circuit through the power supply terminal 130, the output terminals 131 and 132, and a terminal 133 connected to the ground GND.

The operation of the above-described exemplary microphone is now described. The mid unit 1 outputs sound signals through electroacoustic conversion of sound waves from the front of the microphone body. The sound signals are subjected to impedance conversion by the FET 5 for output. The output signals are mid signals M. The right unit 2 outputs sound signals through electroacoustic conversion of sound waves from the right of the microphone body. The sound signals are subjected to impedance conversion by the FET 7 for output. The left unit 3 outputs sound signals through electroacoustic conversion of sound waves from the left of the microphone body. The sound signals are subjected to impedance conversion by the FET 9 for output. The mid signals M are sent to the diaphragm 21 of the right unit 2 to drive the diaphragm 21, and sent to the diaphragm 31 of the left unit 3 to drive the diaphragm 31. As a result, the right unit 2 outputs signals M+R as the sum of sound signals, which are hereinafter referred to sound signals "R", subjected to electroacoustic conversion by the right unit 2 itself and the mid signals M. In addition, the left unit 3 outputs signals M+L as the sum of sound signals, which are hereinafter referred to sound signals "L", subjected to electroacoustic conversion by the left unit 3 itself and the mid signals M.

The signals M+R and M+L are, respectively, output from the output terminals 131 and 132 through the buffer 10 having the transistors 110 and 120. The signals M+R are output from the output terminal 131 as right-channel signals, and the signals M+L are output from the output terminal 132 as left-channel signals. In this way, the exemplary narrow directional stereo microphone shown in FIG. 1 outputs stereo signals separated in the right-channel signals and the left-channel signals.

The mid signals M drive the diaphragm 21 of the right unit 2 and the diaphragm 31 of the left unit 3 as described above. This means that the mid signals M are electrically applied to each diaphragm. Hence, the mid signals M are not limitedly sent to the diaphragms 21 and 31 of the right and left units 2 and 3 as in the exemplary microphone, and may be sent to the fixed electrodes 22 and 32 of the right and left units 2 and 3 so that the right and left signals are output from the diaphragms 21 and 31, respectively. Similarly, in the mid unit 1, the fixed electrode 12 may be connected to the ground GND so that the mid signal M are output from the diaphragm 11 and sent to the right and left units 2 and 3. If the signals from the right and left units 2 and 3 and the signals from the mid unit 1 are output from the respective diaphragms as described above, the phases of the respective signals are inverted. Thus, the circuit for each unit is preferably designed to invert the phases of the signals output from the unit.

Figure 2:
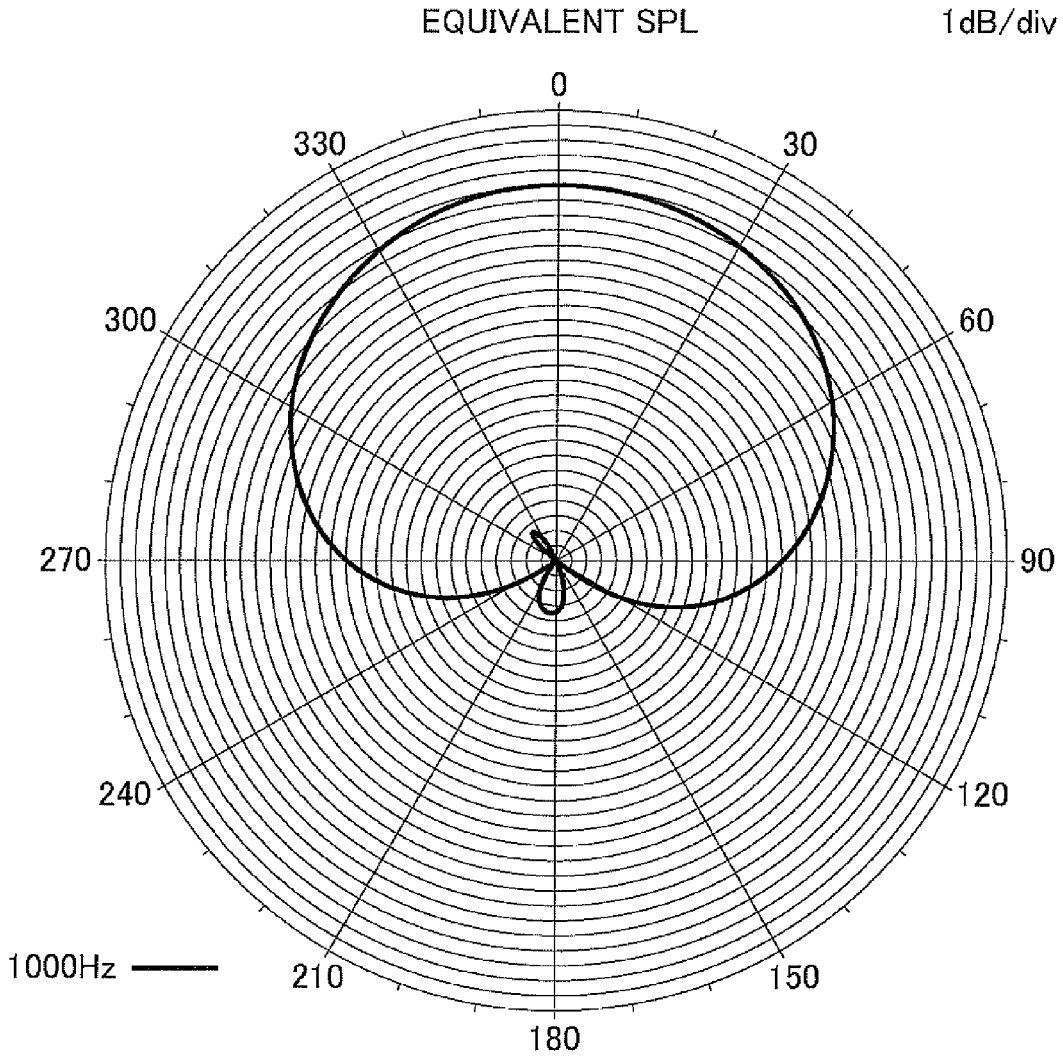
FIG. 2 is a graph illustrating directional characteristics of a mid unit of the exemplary microphone.
Figure 3:
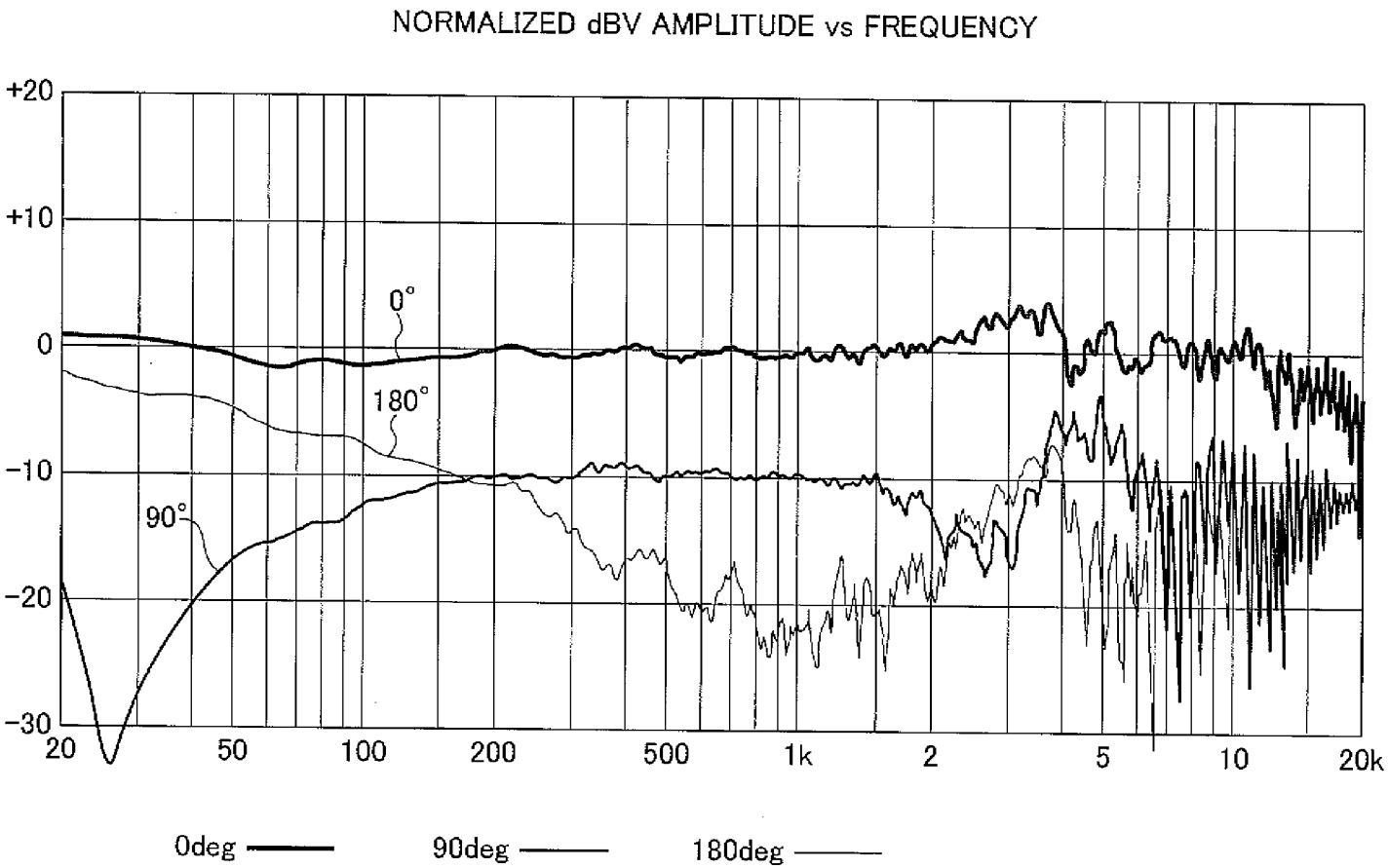
FIG. 3 is a graph illustrating frequency characteristics of the mid unit of the exemplary microphone.

FIGS. 2 to 11 are graphs illustrating the measured directional characteristics and frequency characteristics of the exemplified microphone according to the present invention. FIG. 2 illustrates the directional characteristics of the mid unit 1. Since the mid unit 1 has narrow directionality, its directionality narrowly spreads in the horizontal direction, or concentrates in the front direction. FIG. 3 illustrates the frequency characteristics of the mid unit 1. The frequency characteristic spectrum is substantially flat from a low frequency to a high frequency for sounds in the direction of the directional axis of 0°, namely, sounds from the front.

Figure 4:
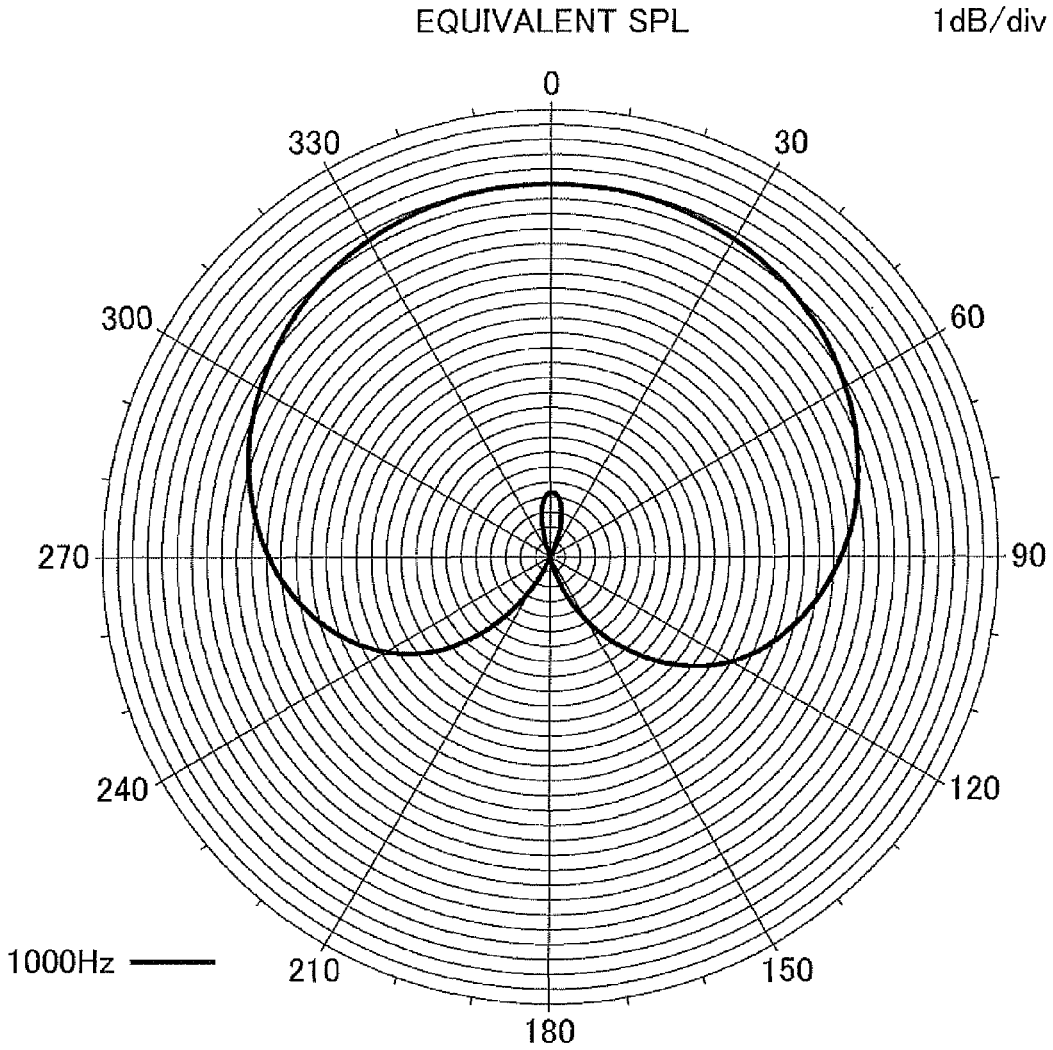
FIG. 4 is a graph illustrating directional characteristics of a left unit of the exemplary microphone.
Figure 5:
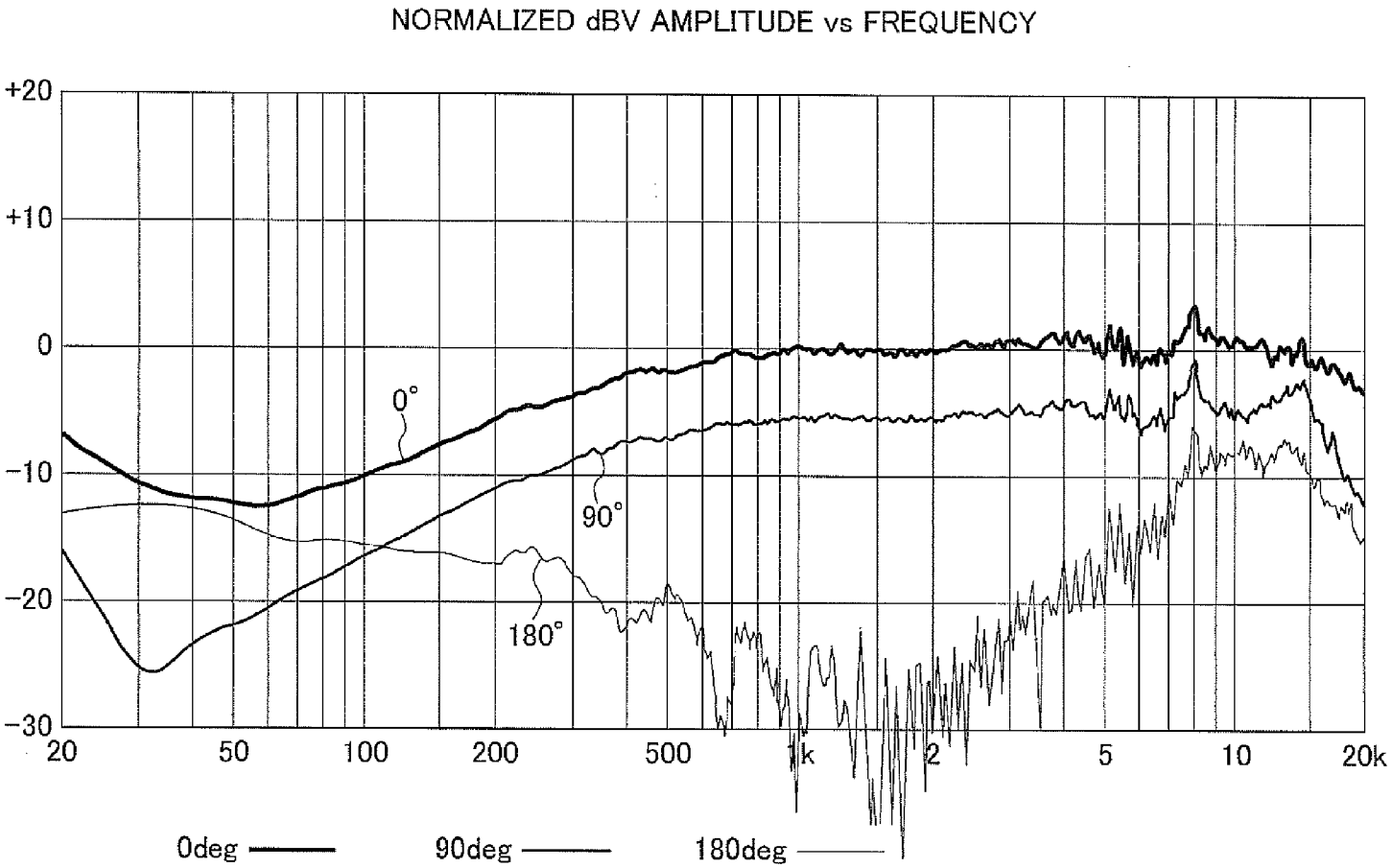
FIG. 5 is a graph illustrating frequency characteristics of the left unit of the exemplary microphone.
Figure 6:
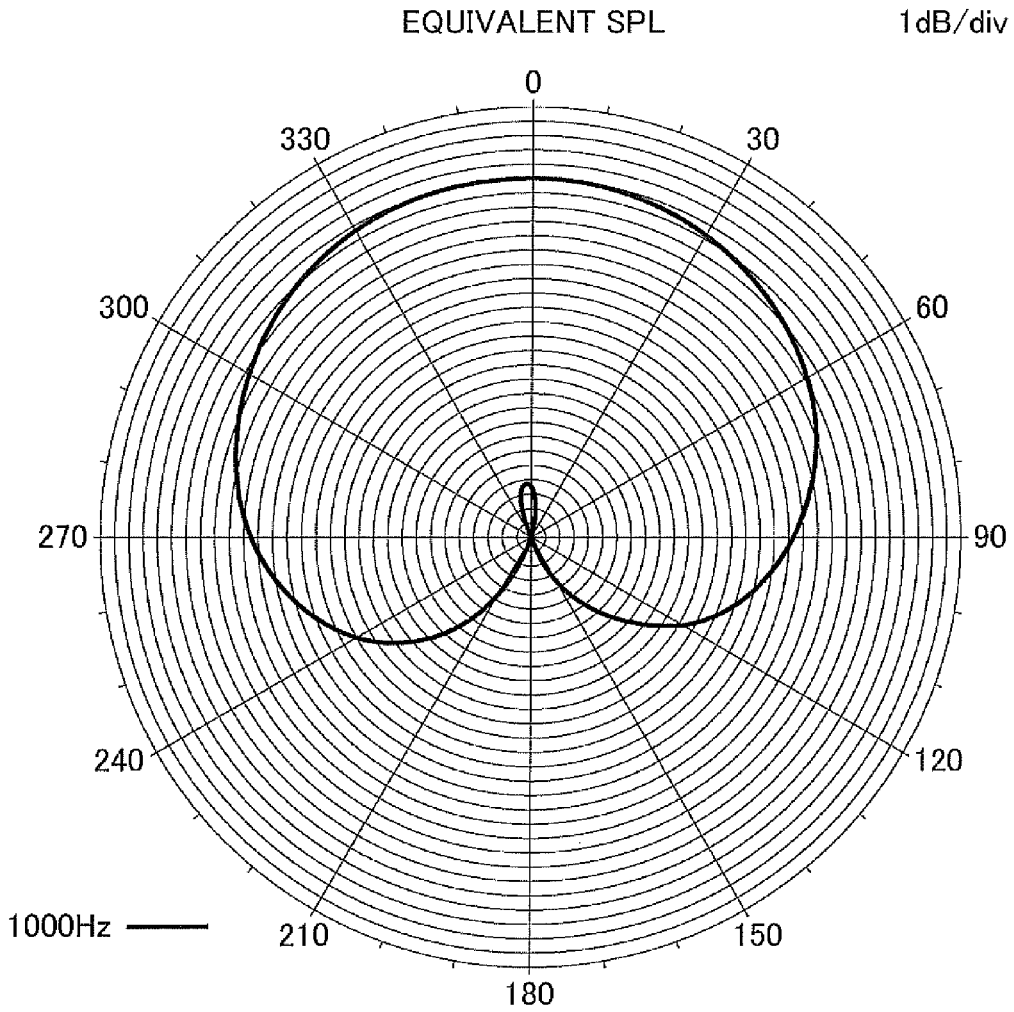
FIG. 6 is a graph illustrating directional characteristics of a right unit of the exemplary microphone.
Figure 7:
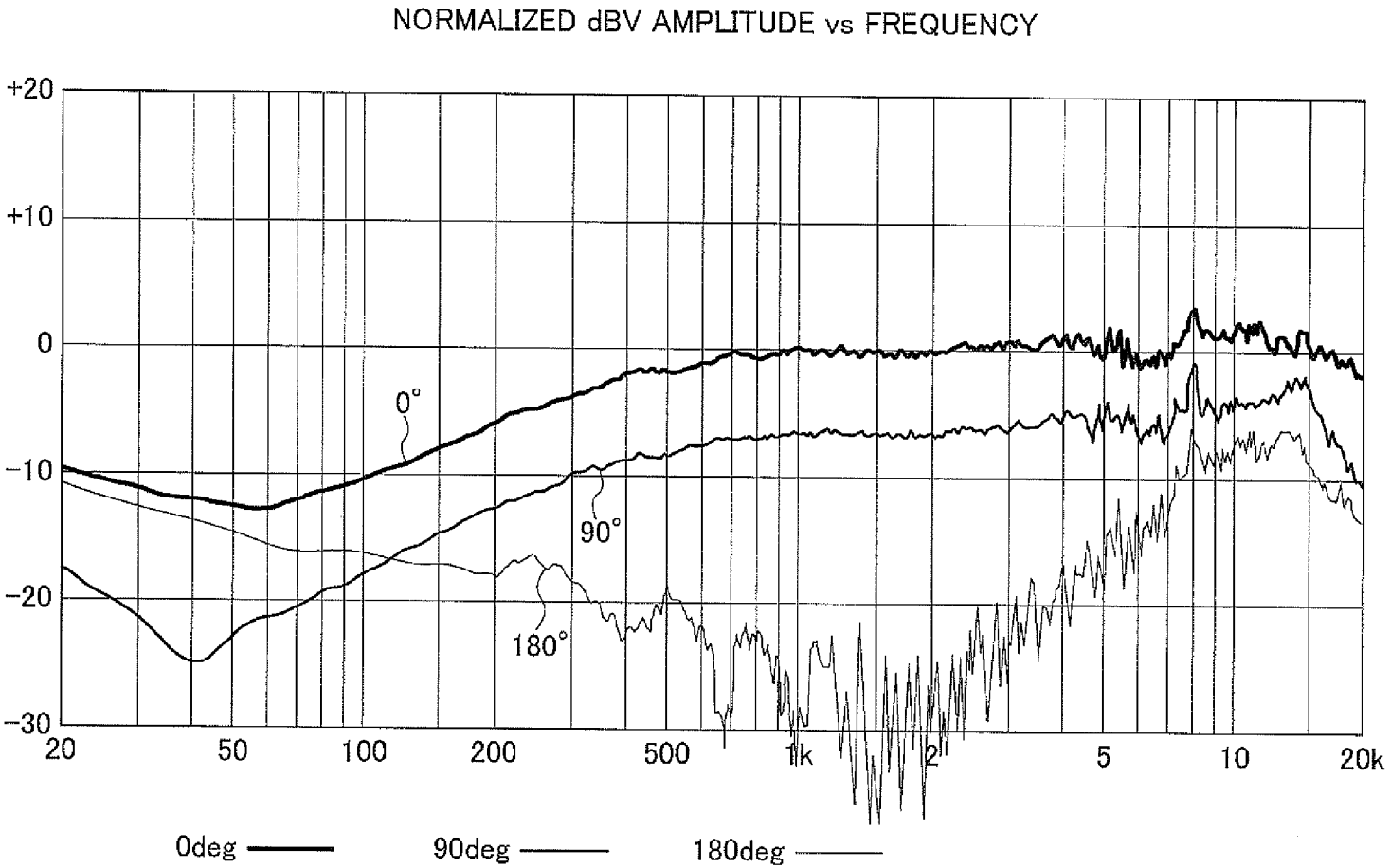
FIG. 7 is a graph illustrating frequency characteristics of the right unit of the exemplary microphone.

FIG. 4 illustrates the directional characteristics of the left unit 3, FIG. 5 illustrates the frequency characteristics of the left unit 3, FIG. 6 illustrates the directional characteristics of the right unit 2, and FIG. 7 illustrates the frequency characteristics of the right unit 2. In the directional characteristics illustrated in FIGS. 4 and 6, the front direction of each of the right and left units 2 and 3 is shown as the directional axis of 0°. Since the right unit 2 and the left unit 3 have unidirectionality and are produced under the same specification, the directional characteristics shown in FIGS. 4 and 6 are substantially the same, and the frequency characteristics shown in FIGS. 5 and 7 are also substantially the same. In the frequency characteristics shown in FIGS. 5 and 7, the signal level decreases in a low frequency region in the front direction, or at 0°, in each unit.

Figure 8:
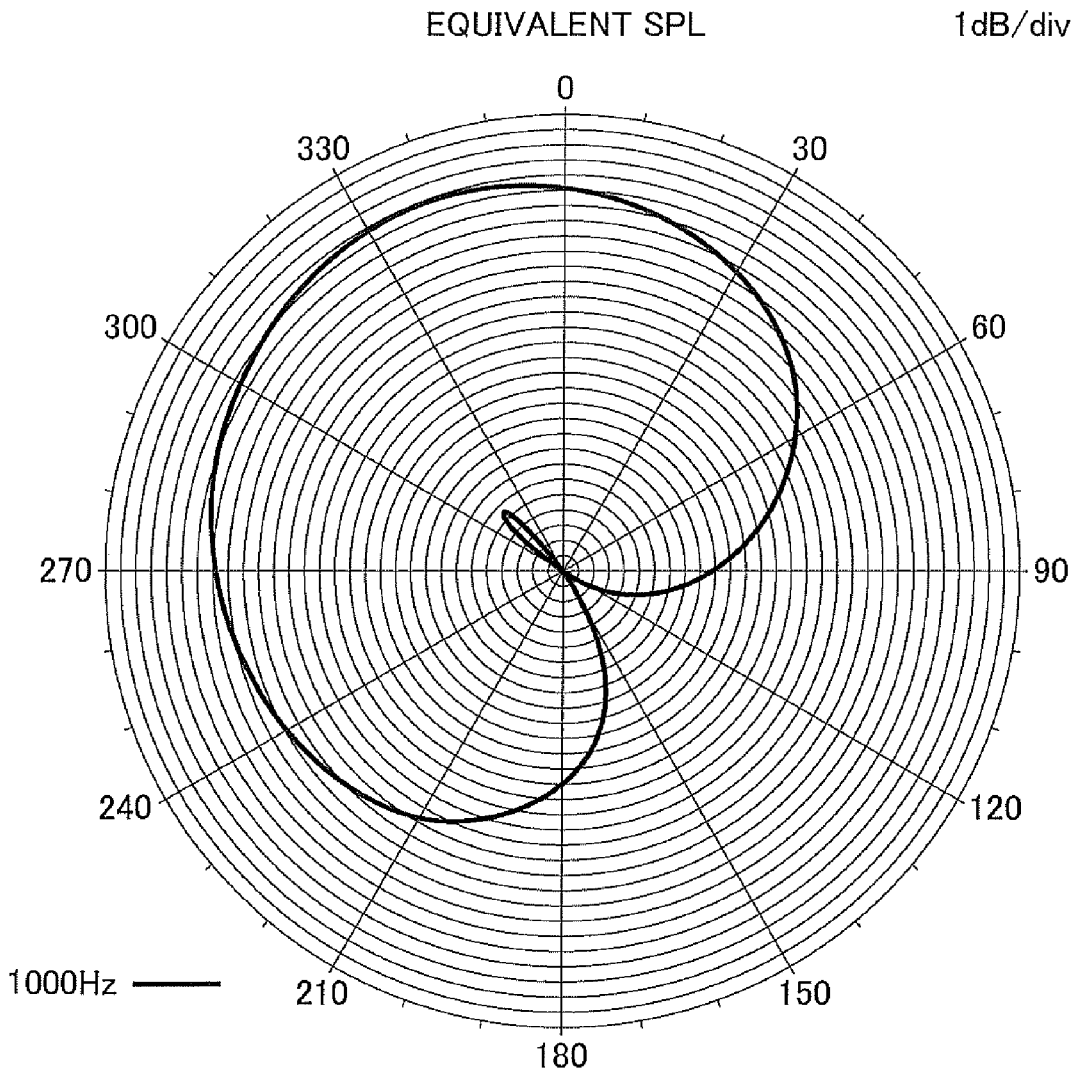
FIG. 8 is a graph illustrating directional characteristics of a left channel signal obtained through addition of output of the mid unit and output of the left unit of the exemplary microphone.
Figure 9:
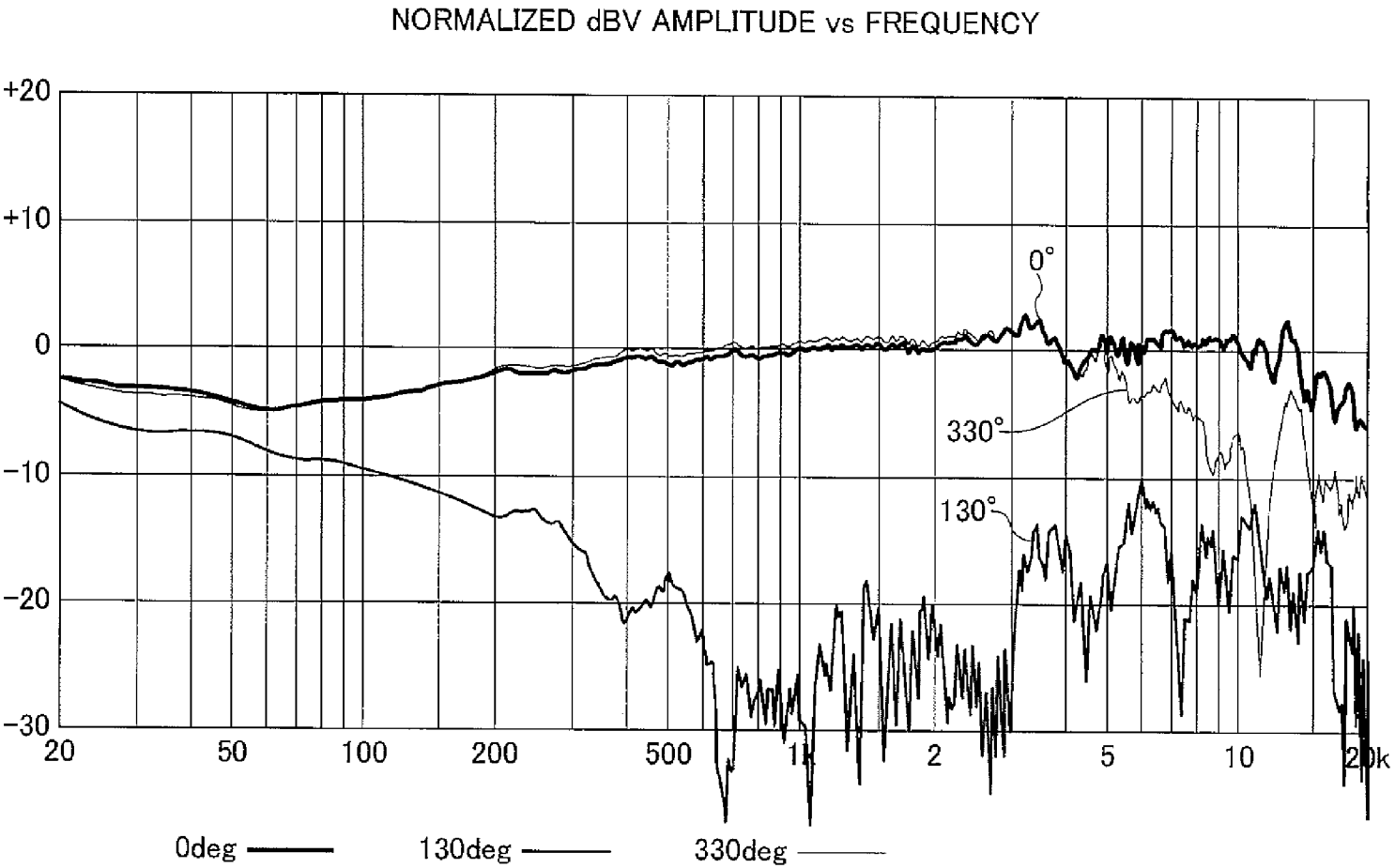
FIG. 9 is a graph illustrating frequency characteristics of the left channel signal from the exemplary microphone.
Figure 10:
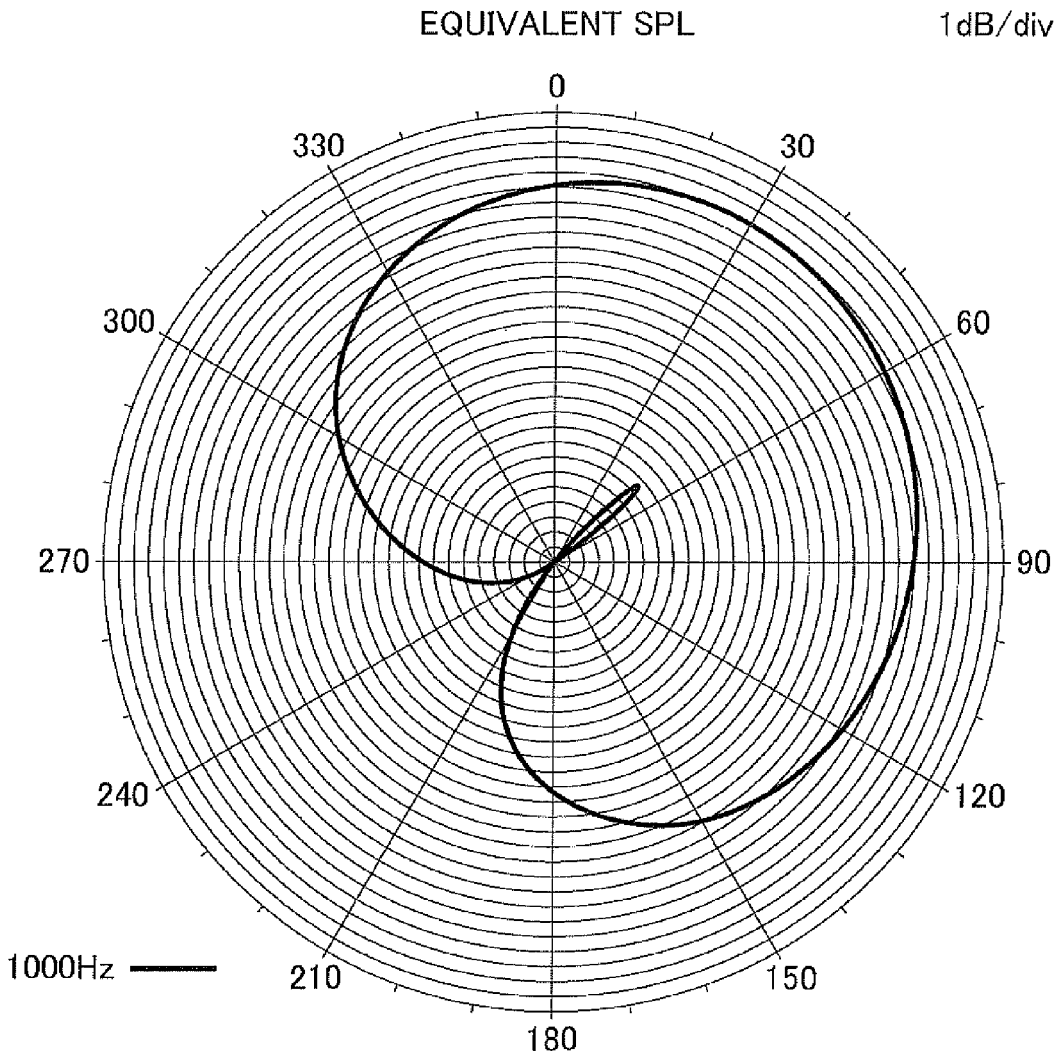
FIG. 10 is a graph illustrating directional characteristics of a right channel signal obtained through addition of output of the mid unit and output of the right unit of the exemplary microphone.
Figure 11:
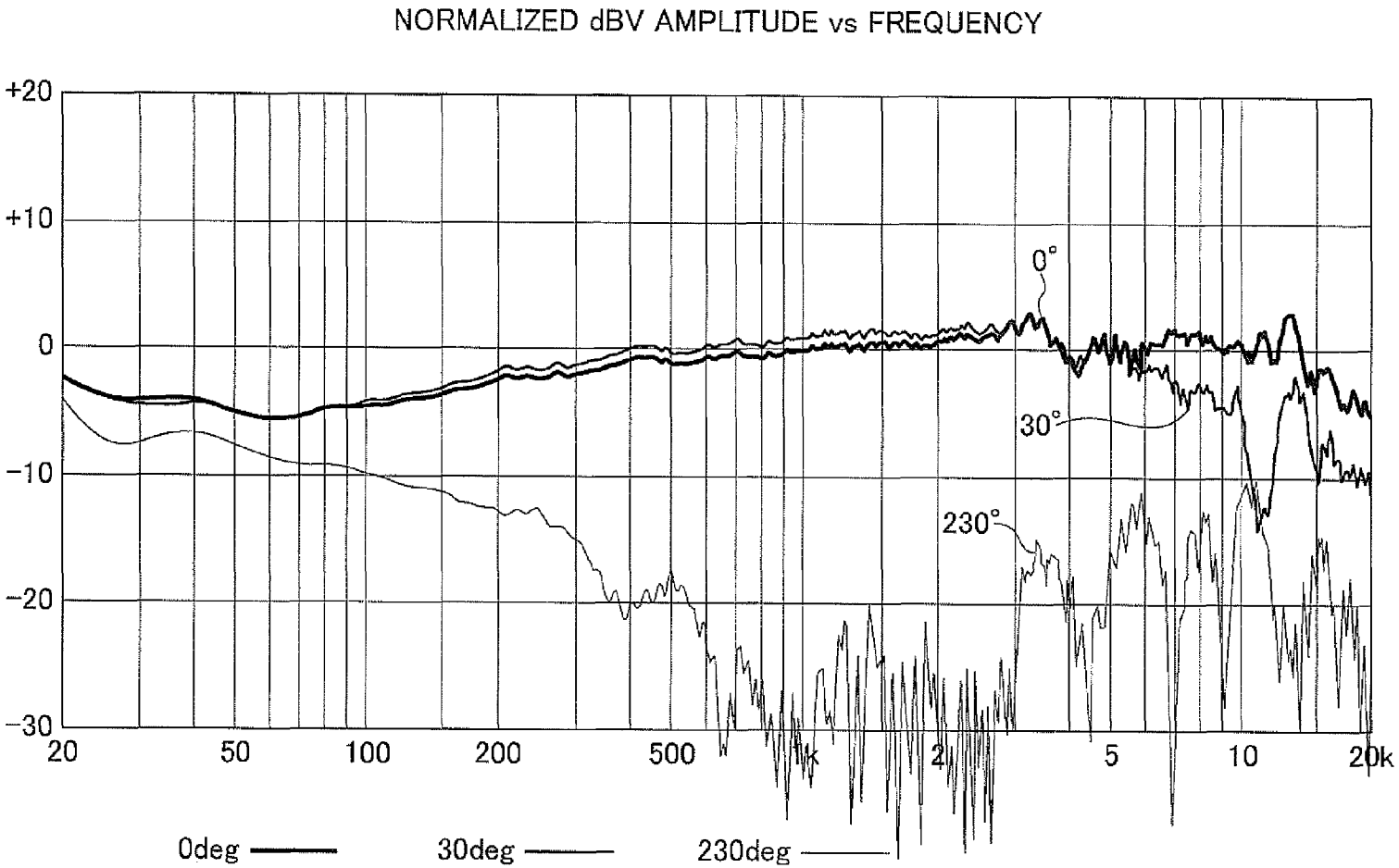
FIG. 11 is a graph illustrating frequency characteristics of the right channel signal from the exemplary microphone.
Figure 12:
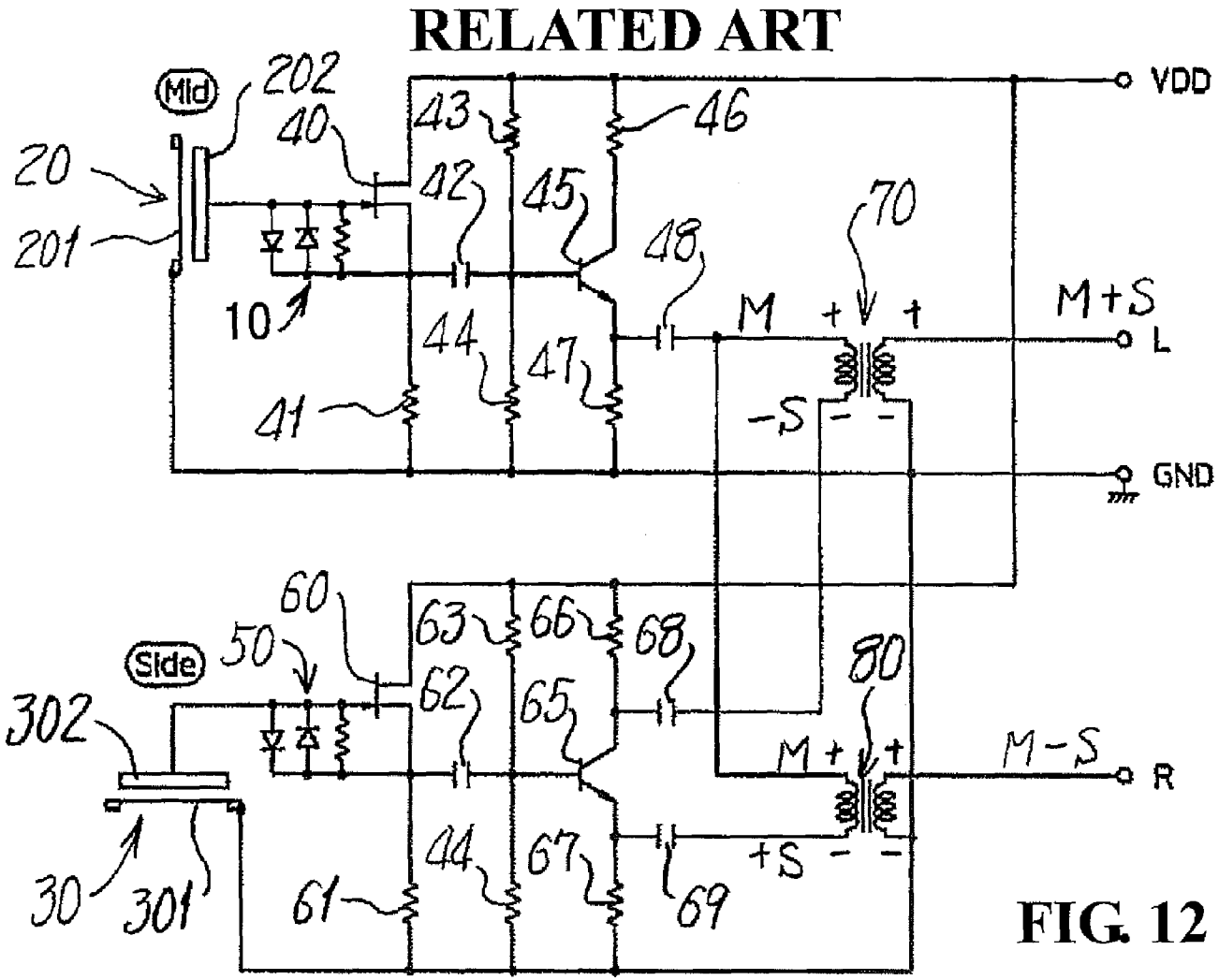
FIG. 12 is a circuit diagram illustrating a typical conventional stereo microphone.

FIG. 8 illustrates the directional characteristics of the signals output from the left channel, namely, the signals M+L, and FIG. 9 illustrates the frequency characteristics of the signals M+L. FIG. 10 illustrates the directional characteristics of the signals output from the right channel, namely, the signals M+R, and FIG. 11 illustrates the frequency characteristics of the signals M+R. In FIGS. 8 and 10, the front direction of the microphone body, or the direction of the directional axis of the mid unit 1, is shown as 0°. FIG. 8 shows that the directional axis of the left channel signals, the signals M+L, is inclined to the left at substantially 30°. FIG. 10 shows that the directional axis of the right channel signals, the signals M+R, is inclined to the right at substantially 30°. This achieves the stereo signals based on respective sounds from the right and the left. In each of the frequency characteristics shown in FIGS. 9 and 11, the signal level in the front direction, or at 0°, is substantially flat from a low frequency band to a high frequency band.

The exemplary microphone described above does not include a bidirectional unit as a side unit, which is essential for an MS stereo microphone. Hence, the exemplary microphone cannot provide stereo signals that give high echolocation feeling, but can securely collect target sounds, and can provide stereo signals that give feeling of arrival of sounds.

In addition, the exemplary microphone can provide the stereo signals by directly applying the signals from the mid unit to the right and left units. Hence, the exemplary microphone does not require a matrix circuit, which is essential for the conventional MS stereo microphones, and does not require an expensive bidirectional unit. Consequently, the exemplary microphone achieves reductions in cost, weight, and size.

INDUSTRIAL APPLICABILITY

The narrow directional stereo microphone according to the present invention can be used as a microphone for collecting ambient sounds or a microphone for interview in sports broadcasting or sound recording. The microphone can be used in various fields due to its excellent frequency characteristics.

The invention claimed is:

1. A narrow directional stereo microphone comprising:

a mid capacitor microphone unit having narrow directionality disposed such that a directional axis of the mid capacitor microphone unit aligns to a major axis of a microphone body; and a unidirectional right capacitor microphone unit and a unidirectional left capacitor microphone unit disposed symmetrically with respect to the major axis such that directional axes of the unidirectional right and left capacitor microphone units are perpendicular to the major axis, wherein signals output from the mid capacitor microphone unit are sent to one of a diaphragm and a fixed electrode of the unidirectional right capacitor microphone unit and to one of a diaphragm and a fixed electrode of the unidirectional left capacitor microphone unit, and right channel signals are output from the other of the diaphragm and the fixed electrode of the unidirectional right capacitor microphone unit, and left channel signals are output from the other of the diaphragm and the fixed electrode of the unidirectional left capacitor microphone unit.

2. The narrow directional stereo microphone according to claim 1, wherein the signals output from the mid capacitor microphone unit are sent to the diaphragm of the unidirectional right capacitor microphone unit and to the diaphragm of the unidirectional left capacitor microphone unit, and the right channel signals are output from the fixed electrode of the unidirectional right capacitor microphone unit, and the left channel signals are output from the fixed electrode of the unidirectional left capacitor microphone unit.

3. The narrow directional stereo microphone according to claim 1, wherein the signals output from the mid capacitor microphone unit are sent to the fixed electrode of the right capacitor microphone unit and to the fixed electrode of the left capacitor microphone unit, and the right channel signals are output from the diaphragm of the unidirectional right capacitor microphone unit, and the left channel signals are output from the diaphragm of the unidirectional left capacitor microphone unit.

4. The narrow directional stereo microphone according to claim 1, wherein the signals from the mid capacitor microphone unit are output from the fixed electrode thereof through an impedance conversion circuit.

5. The narrow directional stereo microphone according to claim 2, wherein the signals from the mid capacitor microphone unit are output from the fixed electrode thereof through an impedance conversion circuit.

6. The narrow directional stereo microphone according to claim 3, wherein the signals from the mid capacitor microphone unit are output from the fixed electrode thereof through an impedance conversion circuit.

7. The narrow directional stereo microphone according to claim 1, wherein the signals from the mid capacitor microphone unit are output from the diaphragm thereof through an impedance conversion circuit.

8. The narrow directional stereo microphone according to claim 2, wherein the signals from the mid capacitor microphone unit are output from the diaphragm thereof through an impedance conversion circuit.

9. The narrow directional stereo microphone according to claim 3, wherein the signals from the mid capacitor microphone unit are output from the diaphragm thereof through an impedance conversion circuit.

10. The narrow directional stereo microphone according to claim 1, wherein the right channel signals from the unidirectional right capacitor microphone unit and the left channel signals from the unidirectional left capacitor microphone unit are output from the respective fixed electrodes of the unidirectional right and left capacitor microphone units through respective impedance conversion circuits.

11. The narrow directional stereo microphone according to claim 4, wherein the right channel signals from the unidirectional right capacitor microphone unit and the left channel signals from the unidirectional left capacitor microphone unit are output from the respective fixed electrodes of the unidirectional right and left capacitor microphone units through respective impedance conversion circuits.

12. The narrow directional stereo microphone according to claim 7, wherein the right channel signals from the unidirectional right capacitor microphone unit and the left channel signals from the unidirectional left capacitor microphone unit are output from the respective fixed electrodes of the unidirectional right and left capacitor microphone units through respective impedance conversion circuits.

13. The narrow directional stereo microphone according to claim 1, wherein the right channel signals from the unidirectional right capacitor microphone unit and the left channel signals from the unidirectional left capacitor microphone unit are output from the respective diaphragms of the unidirectional right and left capacitor microphone units through respective impedance conversion circuits.

14. The narrow directional stereo microphone according to claim 4, wherein the right channel signals from the unidirectional right capacitor microphone unit and the left channel signals from the unidirectional left capacitor microphone unit are output from the respective diaphragms of the unidirectional right and left capacitor microphone units through respective impedance conversion circuits.

15. The narrow directional stereo microphone according to claim 7, wherein the right channel signals from the unidirectional right capacitor microphone unit and the left channel signals from the unidirectional left capacitor microphone unit are output from the respective diaphragms of the right and left capacitor microphone units through respective impedance conversion circuits.

16. The narrow directional stereo microphone according to claim 1, wherein the right channel signals from the unidirectional right capacitor microphone unit and the left channel signals from the unidirectional left capacitor microphone unit are output through a buffer amplifier.

17. The narrow directional stereo microphone according to claim 11, wherein the right channel signals from the unidirectional right capacitor microphone unit and the left channel signals from the unidirectional left capacitor microphone unit are output through a buffer amplifier.

18. The narrow directional stereo microphone according to claim 12, wherein the right channel signals from the unidirectional right capacitor microphone unit and the left channel signals from the unidirectional left capacitor microphone unit are output through a buffer amplifier.

19. The narrow directional stereo microphone according to claim 14, wherein the right channel signals from the unidirectional right capacitor microphone unit and the left channel signals from the unidirectional left capacitor microphone unit are output through a buffer amplifier.

20. The narrow directional stereo microphone according to claim 15, wherein the right channel signals from the unidirectional right capacitor microphone unit and the left channel signals from the unidirectional left capacitor microphone unit are output through a buffer amplifier.

* * * * *